US012584706B2

(12) United States Patent
Shank

(10) Patent No.: US 12,584,706 B2
(45) Date of Patent: Mar. 24, 2026

(54) FRONT REMOVEABLE TRIGGER SHOE

(71) Applicant: Warwick Tactical LLC, Landisville, PA (US)

(72) Inventor: Brian Eugene Shank, Manheim, PA (US)

(73) Assignee: Warwick Tactical LLC, Landisville, PA (US)

( * ) Notice: Subject to any disclaimer, the term of this patent is extended or adjusted under 35 U.S.C. 154(b) by 0 days.

(21) Appl. No.: 18/936,441

(22) Filed: Nov. 4, 2024

(65) Prior Publication Data

US 2025/0146778 A1 May 8, 2025

Related U.S. Application Data

(60) Provisional application No. 63/547,117, filed on Nov. 2, 2023.

(51) Int. Cl.
*F41A 19/10* (2006.01)

(52) U.S. Cl.
CPC ..... *F41A 19/10* (2013.01)

(58) Field of Classification Search
CPC ..... F41A 19/09; F41A 19/10; F41A 19/16
USPC ..... 42/69.01, 69.02; 89/136
See application file for complete search history.

(56) References Cited

U.S. PATENT DOCUMENTS

| | | | | | |
|---|---|---|---|---|---|
| 984,519 | A | | 2/1911 | Browning | |
| 1,070,582 | A | | 8/1913 | Browning | |
| 4,955,155 | A | * | 9/1990 | Jones | F41A 19/10 42/69.01 |
| 5,822,903 | A | * | 10/1998 | Davis, Sr. | F41A 19/16 42/70.07 |
| 6,164,001 | A | * | 12/2000 | Lee | F41A 19/17 42/69.01 |
| 6,298,594 | B1 | | 10/2001 | Strayer | |
| 9,970,724 | B1 | * | 5/2018 | Acker | F41A 17/46 |
| 2012/0117841 | A1 | * | 5/2012 | Joubert | F41A 19/16 42/69.01 |
| 2019/0041150 | A1 | * | 2/2019 | Lopata | F41A 19/10 |
| 2019/0137206 | A1 | * | 5/2019 | Lopata | F41A 19/10 |
| 2023/0243612 | A1 | * | 8/2023 | McNamee | F41A 17/46 42/69.02 |

* cited by examiner

*Primary Examiner* — Bret Hayes
(74) *Attorney, Agent, or Firm* — Ilya Chernyavskiy; Bennet K. Langlotz; Langlotz Patent & Trademark Works, LLC

(57) ABSTRACT

A trigger assembly for a 1911 format pistol comprising of a trigger bow having a forward portion defining a first threaded portion, a threaded fastener having a second threaded portion mateable with the first threaded portion, and a trigger shoe configured to operably engage the threaded fastener to secure the trigger shoe to the trigger bow.

27 Claims, 10 Drawing Sheets

FRONT REMOVEABLE TRIGGER SHOE

CROSS-REFERENCE TO RELATED APPLICATIONS

This application claims priority to U.S. Provisional Patent Application No. 63/547,117 filed on Nov. 2, 2023 entitled "FRONT REMOVABLE TRIGGER SHOE," hereby incorporated by reference in its entirety for all that is taught and disclosed therein

FIELD OF THE TECHNOLOGY

The present disclosure relates to firearms, more particularly triggers.

BACKGROUND AND SUMMARY

Historically triggers for 1911 type handguns, including 2011 model handguns, were manufactured and installed as part of the initial handgun assembly procedure. Such triggers have two main components: a connecting piece, commonly referred to as a trigger bow, is internal to the handgun frame and is seated in front of the hammer, sear, and safety and transmits movement to the sear to allow the firearm to discharge. A trigger shoe is at the opposite end of the trigger bow, away from the sear, and is partially external to the frame of the handgun, within the trigger guard. The trigger shoe is the part that the shooter pushes with their finger to transmit movement through the bow to release the sear and cause the firearm to discharge. The trigger shoe is often a distinct piece that is connected to the trigger bow. To replace the trigger shoe, the handgun needs to be disassembled, the trigger removed, and a different trigger is installed. Some shooters desire different shaped trigger shoes to accommodate different needs, and may even desire to interchange between shapes for different purposes within the same event but without having to disassemble the firearm.

A removable trigger shoe is an important feature to some users, such as competition shooters, who change the shoe for personal preferences, or for hunters, to change the shoe for glove thickness.

As described in U.S. Pat. No. 6,298,594 to Sandy L. Strayer, which is herein incorporated by reference in its entirety for all that is taught and disclosed therein. It appears to have a trigger shoe that can detach and interchange with other trigger shoes by shifting laterally to disengage from a portion of the trigger bow when the trigger is in the forward position. It appears to be secured by a screw. While this enables a change in trigger shoe face geometry without gunsmithing, this approach is cumbersome and complex, and introduces other disadvantages due to geometry and structural limitations. Furthermore, the retaining screw to secure the show from lateral movement is disclosed to be in a low position, thus prohibiting a secondary screw from serving in the same area to prevent overtravel of the trigger.

Accordingly, a need exists for a trigger assembly for a 1911 format pistol comprising of a trigger bow having a forward portion defining a first threaded portion threaded receptacle and further defining an aperture that allows the passage of a magazine through the aperture. A threaded fastener has a second threaded portion mateable with the first threaded portion. A trigger shoe is configured to operably engage the threaded fastener to secure the trigger shoe to the trigger bow.

The fastener may be rotatable with respect to the shoe and with respect to the bow. The bow may have an internally threaded receptacle configured to mate with the fastener. The fastener may be free of threaded engagement with the shoe in other embodiments. The fastener includes a right-handed threaded portion and a left handed threaded portion.

DETAILED DESCRIPTION OF A PREFERRED EMBODIMENT

Figure 1:
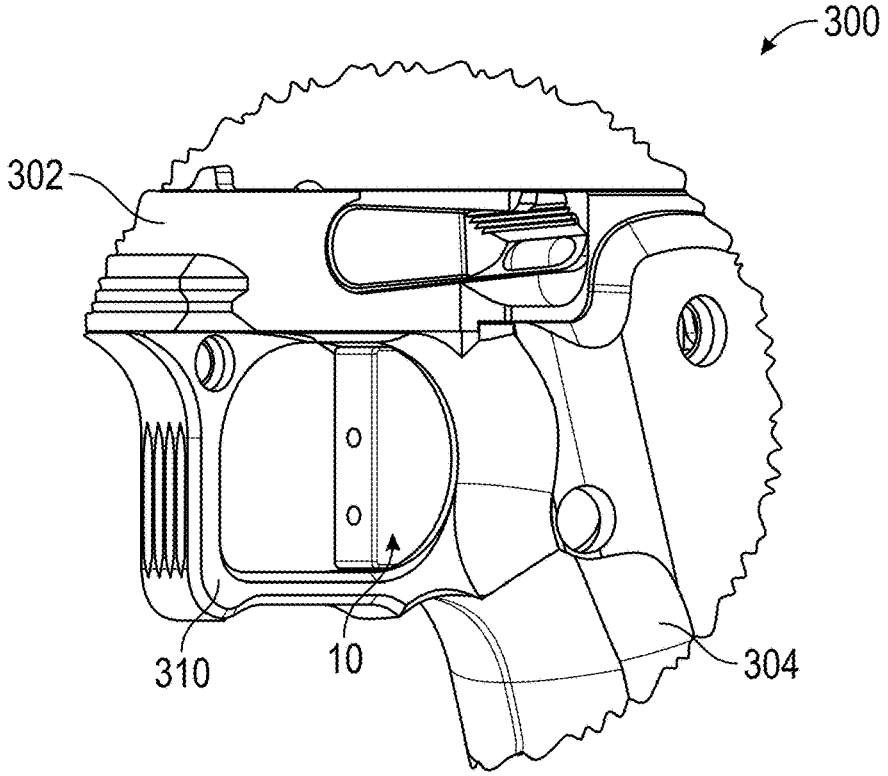
FIG. 1 shows a trigger assembly installed in a handgun.

FIG. 1 shows an embodiment of a trigger assembly 10 installed in a 1911 format pistol 300 having a frame 302 defining a magazine well 304. The trigger assembly includes a trigger shoe 80 shown here partially extending from within the frame. The frame has a trigger guard 310.

Figure 2:
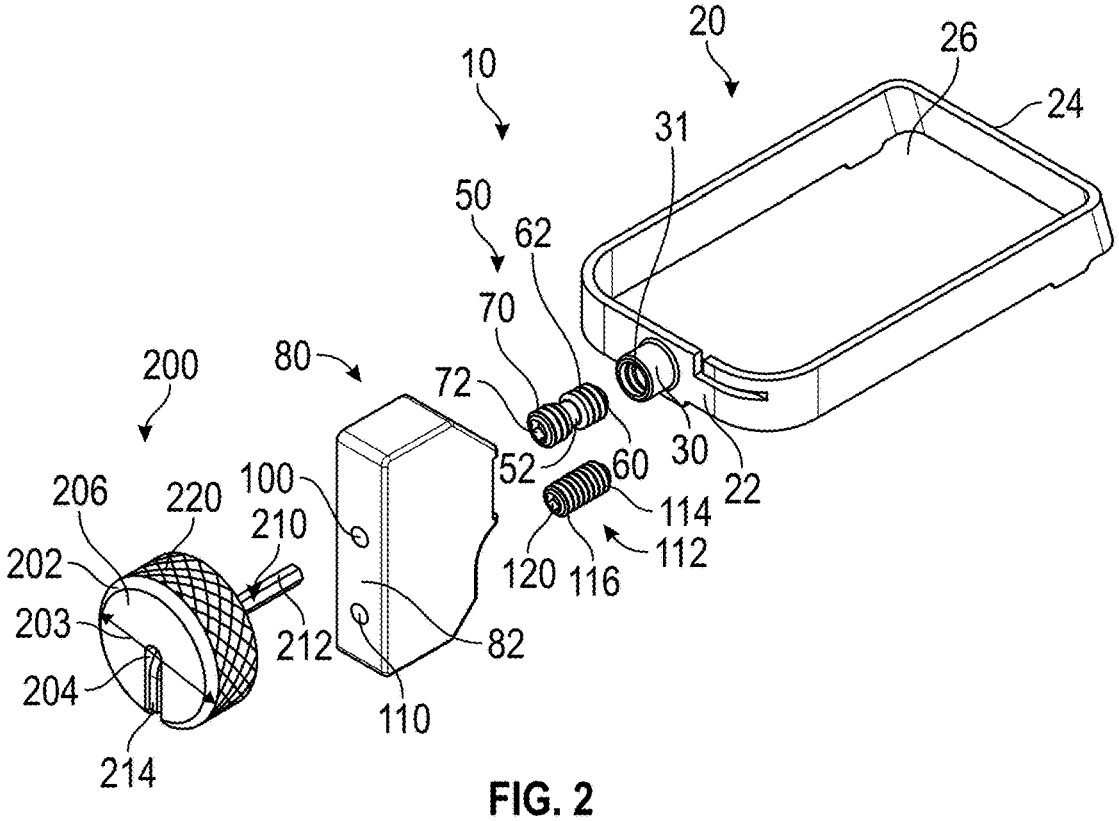
FIG. 2 shows an angled exploded view of the trigger assembly in FIG. 1 with an accompanying installation tool.
Figure 3:
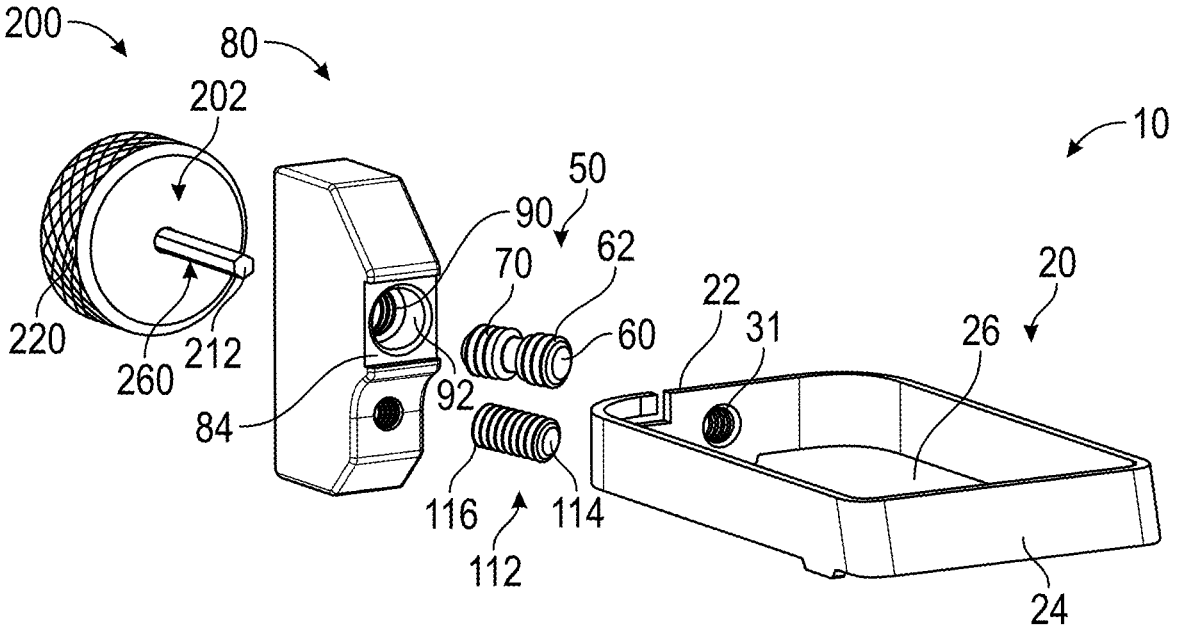
FIG. 3 shows an alternative angled exploded view of the trigger assembly in FIG. 1 with an accompanying installation tool.

FIGS. 2 and 3 show an angled exploded view of the trigger assembly 10 and installation tool 200. The assembly has a trigger bow element or bow 20, a trigger shoe element 80, and an elongated threaded fastener 50. The bow has a forward first end 22 having a boss 30 defining an internally threaded receptacle or bore 31. These threads are right handed as will be discussed below. The bow has a second rear end 24 opposite the first end and the bow defines an aperture 26 between the first end and second end.

The threaded fastener 50 has the form of a set screw, with a first forward left hand threaded portion 70 and a second rear right hand threaded portion 60 mateable with the threaded receptacle 31 of the bow. Between the first portion 70 and second portion 60 is a portion without threads 52.

The assembly 10 further includes a shoe 80 having a first side 82 and second side 84 and defines a passage 100 communicating from the first side to the second side. The passage includes a tool access aperture 102, connection facility 90 along with a rear pocket 92. The connection facility is a left handed threaded internally threaded pocket or bore and is open to the rear. The shoe is configured to operably engage the threaded fastener 50 to secure the shoe 80 to the bow 20. The fastener is rotatable with respect to the shoe. As will be discussed below, the pocket is essentially open only to the rear, as the tool access aperture is smaller in diameter than the threaded bore.

The threaded fastener 50 is rotatable with respect to the bow with the threaded receptacle 31 configured to mate with the fastener. The fastener includes a right-handed threaded portion and a left-handed threaded portion, wherein a first one of the right handed threaded portion and the left handed threaded portion is configured to threadably engage the bow at the receptacle 31, and the other one of the right handed threaded portion and the left handed threaded portion is configured to threadably engage the threaded pocket 90 of the shoe. The fastener is externally threaded and defines a hexagonal pocket 72 configured to engage a tool 200.

The tool 200 comprises of a body 202 defining channel 204 for accommodating a wrench 210. In the present embodiment the wrench is a modified Allen key having a hexagonal end 212 and a curved head 214, with the head retained within the channel 204 so that it does not protrude beyond the forward surface 206 of the tool body. In the present embodiment the body of the tool is circular with a diameter 203 and the circumference has a surface 220 that assists the user in gripping the tool with fingers. In other embodiments the wrench may be in other forms, including but not limited to a hexagonal socket piece inserted into the passage and retained within the passage by features within the channel such as a blocking surface.

The shoe 80 further has a second passage 110 below the passage 100 that is partially threaded 111 and accommodates a piece 112. The piece is threaded at its first end 114 and second end 116. The piece functions as an overtravel stop to prevent unwanted travel of the shoe.

Figure 4:
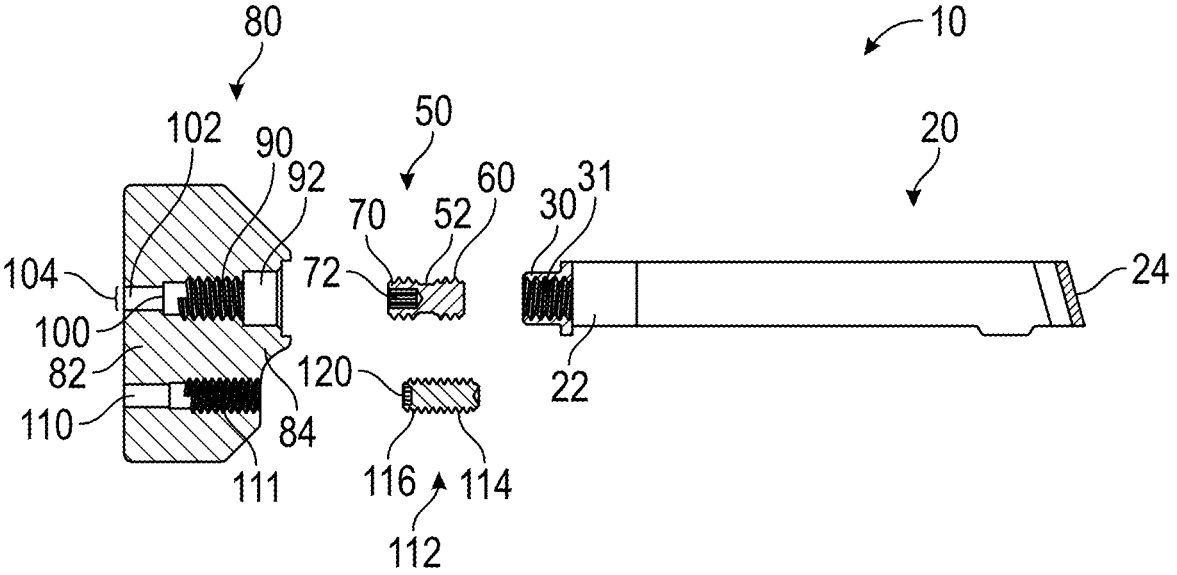
FIG. 4 shows a side section view of the exploded view of the trigger assembly in FIG. 1.

FIG. 4 shows a side section view of an embodiment of the trigger assembly 10 comprising of a trigger bow 20, threaded fastener 50, and trigger shoe 80. The bow having a first end 22 defining a threaded portion 31, a second end 24, and an aperture 26 therein between. In this embodiment the threaded portion is a protruding boss 30 having an internally threaded receptacle 31. The trigger bow has a first end 82 and second end 84 with a passage 100 communicating between the two ends. The passage having a tool access aperture 102 defined by the first end, a rear socket 92 defined by the second end, and connection facility 90 in between. The connection facility is referred to as a threaded pocket and is threaded. The threaded fastener having a first end 60, a middle section 52, and a second end 70. The first end and second end are threaded in opposing directions and the middle section is unthreaded. The second end defines an aperture 72, in this embodiment being a hexagonal socket. The threaded fastener's first end 60 is threaded to be mateable with the internal threads of the threaded portion 31 of the bow. The threaded fastener's second end 70 is threaded to be mateable with the threads of the threaded pocket 90. The first threaded portion 31 being an internally threaded boss in this embodiment fits within the rear pocket 92 of the shoe. The hexagonal end 212 of the wrench 210 (shown in FIG. 5) is inserted into the tool access aperture 102 and through the passage 100 and partially protrudes from the threaded pocket and into the rear pocket 92. The threaded fastener 50 is inserted into the rear pocket and attached to the wrench by inserting the hexagonal end 212 into the hexagonal aperture 72. The wrench is turned to engage the threads of the fastener and the threaded pocket. The bow and threaded fastener are then placed at the bow with the threaded portion 31 contacting the first end 60 of the threaded fastener. The wrench is continued to be turned so that the threads of the fastener thread into the bow until the bow and shoe are brought together completely.

Figure 5:
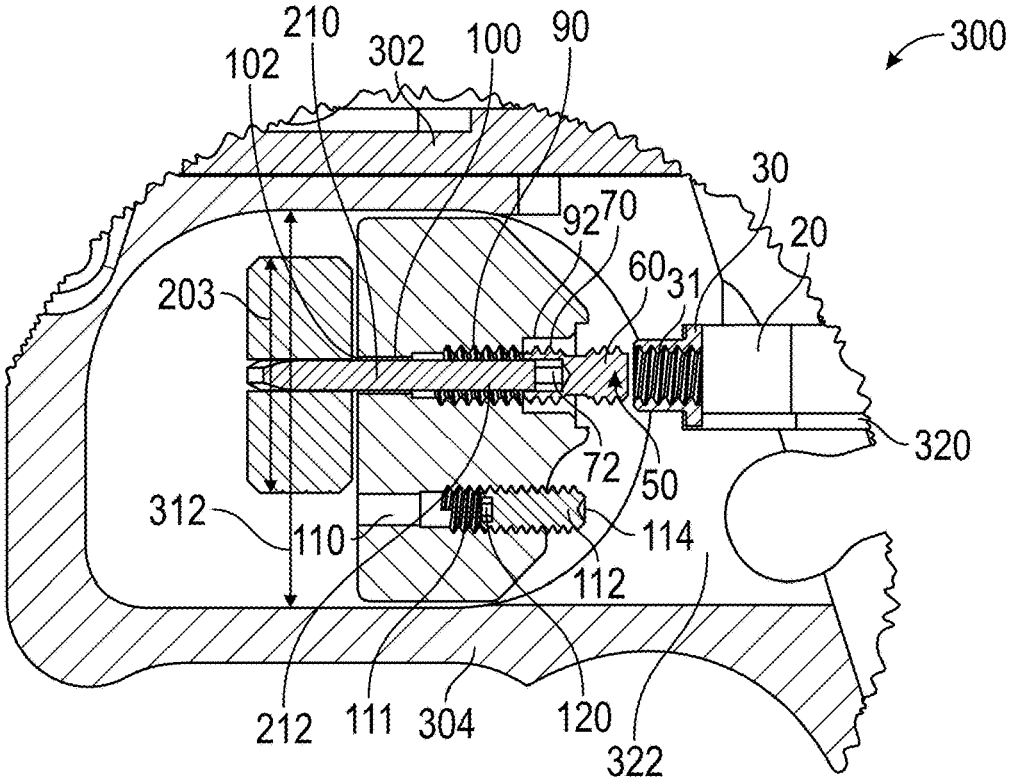
FIG. 5 shows a side section view of the trigger assembly just prior to the point of installation in a firearm.
Figure 6:
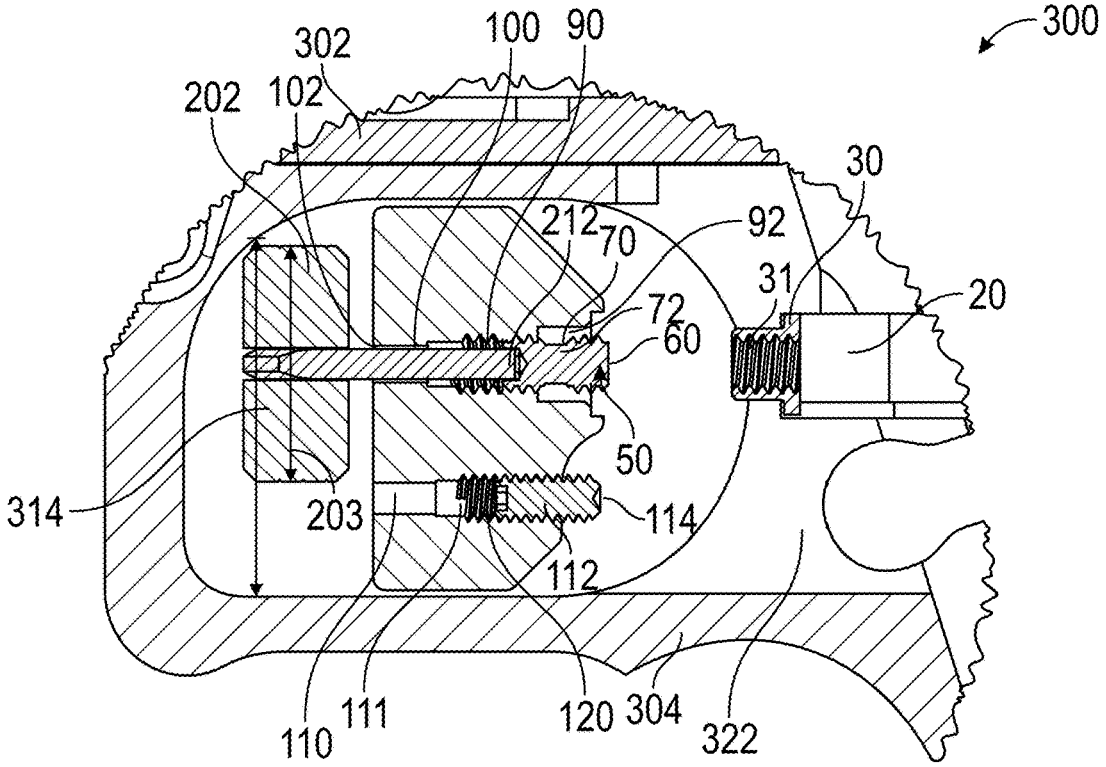
FIG. 6 shows a side section view of the trigger assembly at a point of installation in a firearm.

FIGS. 5 and 6 shows a side section view of an embodiment of the trigger assembly 10 prior to the point of installation in a 1911 format pistol 300. Specifically, the trigger shoe 80 and threaded fastener 50 are connected and the shoe is to be connected to the trigger bow 20. The bow having a first end 22 defining a threaded portion, a second end 24, and an aperture 26 therein between. In this embodiment the threaded portion is a protruding boss 30 having an internally threaded receptacle 31. The trigger shoe has a first end 82 and second end 84 with a passage 100 communicating between the two ends. The passage having a tool access aperture 102 defined by the first end, a rear socket 92 defined by the second end, and connection facility 90 in between. The connection facility is referred to as a threaded pocket and is threaded. The threaded fastener having a first end 60, a middle section 52, and a second end 70. The first end and second end are threaded in opposing directions and the middle section is unthreaded. The second end defines an aperture 72, in this embodiment being a hexagonal socket. The threaded fastener's first end 60 is threaded to be mateable with the internal threads of the threaded portion 31 of the bow. The threaded fastener's second end 70 is threaded to be mateable with the threads of the threaded pocket 90. The first threaded portion being an internally threaded 31 boss 30 in this embodiment fits within the rear pocket 92 of the shoe. The hexagonal end 212 of the wrench 210 is inserted into the tool access aperture 102 and through the passage 100 and partially protrudes from the threaded pocket and into the rear pocket 92. The threaded fastener 50 is inserted into the rear pocket and attached to the wrench by inserting the hexagonal end 212 into the hexagonal aperture 72. FIG. 5 shows the wrench fitted with the fastener but not yet rotated so as to engage the threads of the fastener 50 with the threads of the threaded pocket 90 to reduce the chance of the fastener falling off the wrench. FIG. 6 shows the threaded fastener 50 inserted into the bow's threaded pocket 90. The bow and threaded fastener are placed near the bow with the threaded portion 31 contacting the first end 60 of the threaded fastener. In these figures the fastener and threaded portion are not yet touching but are close. FIG. 5 shows that the shoe is not yet within the trigger shoe passage 322 and can still be moved in and out of the trigger guard 310. FIG. 6 shows the same but the shoe being farther from the bow exemplifies the range of positions that the shoe may be placed within the trigger guard to begin the process of connecting the shoe to the bow.

The body 202 of the installation tool has a smaller diameter 203 than the largest height of the trigger guard's internal space 312 and the second height 314 where the shoe 80 with the tool inserted is free of engagement from bow 20 and not confined by the shoe passage 322.

Figure 7A:
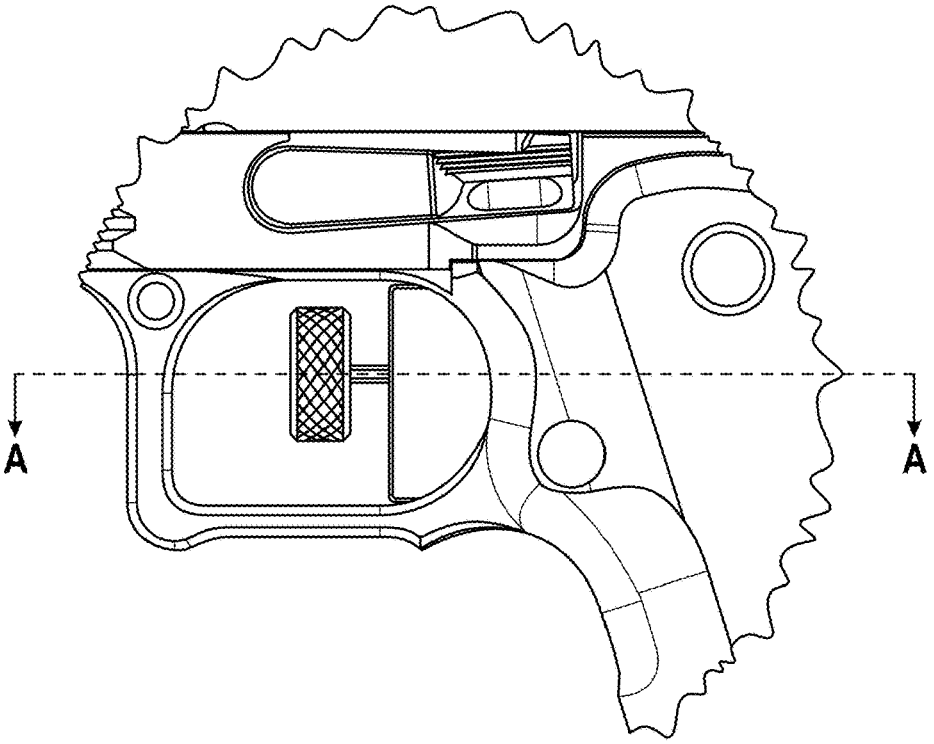
FIG. 7A shows a side view of the trigger assembly installed in a firearm with the tool inserted.
Figure 7B:
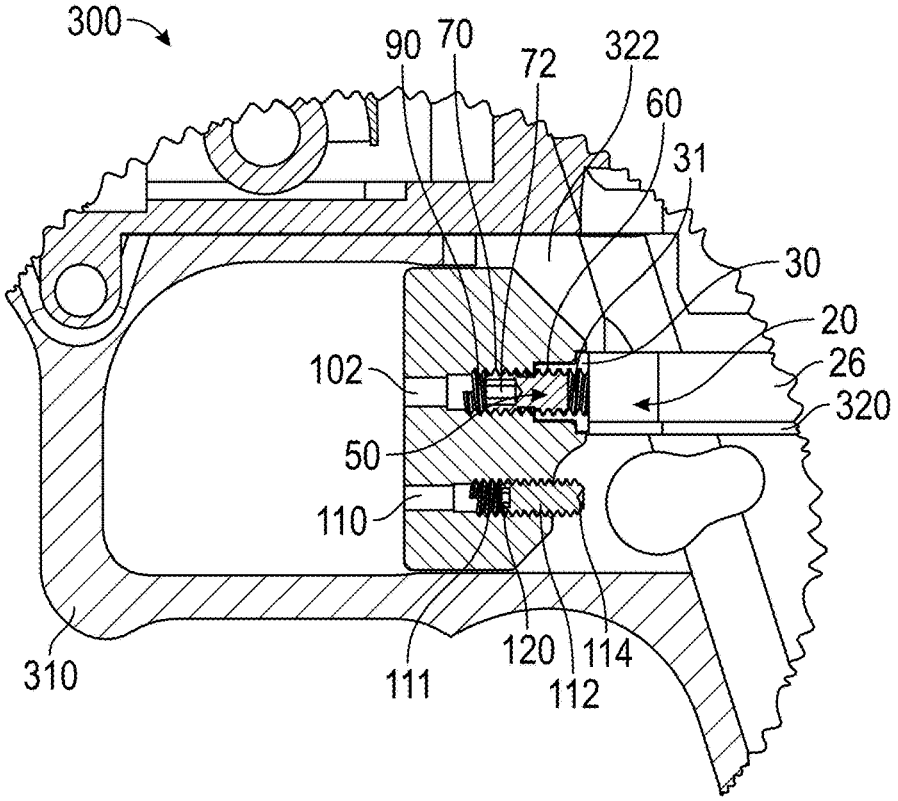
FIG. 7B shows a side section view of FIG. 7A without the tool inserted.
Figure 7C:
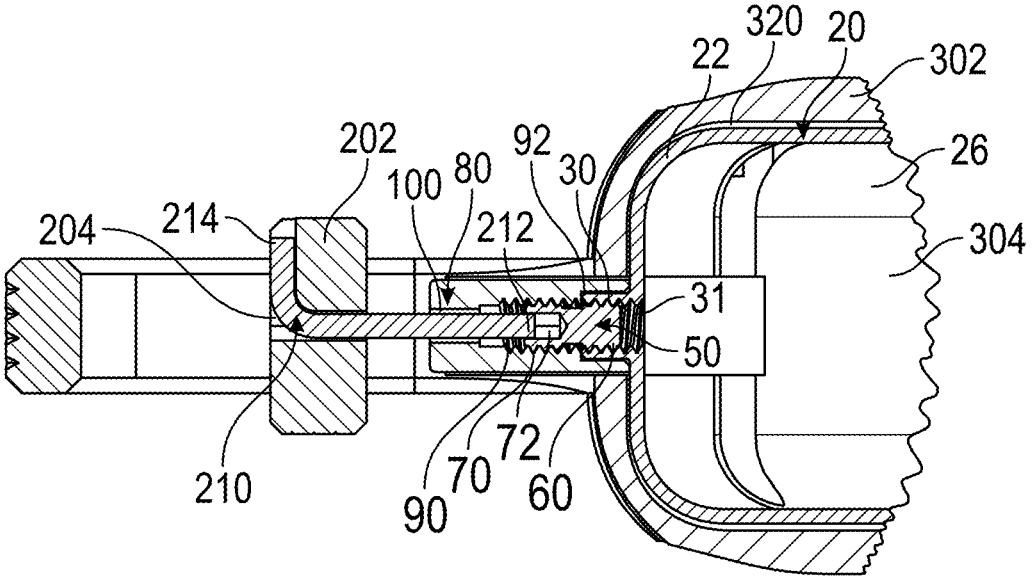
FIG. 7C shows a top-down section view of FIG. 7A.

FIG. 7A through 7C show an embodiment of the trigger assembly 10 installed in a in a 1911 format pistol 300 with the installation tool 200 still inserted. FIG. 7A shows a side view, FIG. 7B shows a side-section view. FIG. 7C shows a top-down section view of FIG. 7A at section line A-A.

The trigger assembly comprises of a bow 20, a shoe 80, and threaded fastener 50. The threaded fastener connects the shoe to the bow and the shoe is partially within trigger shoe passage 322 of frame 302. Passage 322 restricts the lateral and rotational movement of the shoe. The bow having a first end 22 defining a threaded portion 31, a second end 24, and an aperture 26 therein between. In this embodiment the threaded portion is a protruding boss 30 having an internally threaded receptacle 31. The trigger bow has a first end 82 and second end 84 with a passage 100 communicating between the two ends. The passage has a tool access aperture 102 defined by the first end, a rear socket 92 defined by the second end, and connection facility 90 in between. The connection facility is referred to as a threaded pocket and is threaded. The threaded fastener has a first end 60, a middle section 52, and a second end 70. The first end and second end are threaded in opposing directions and the middle section is unthreaded. The second end defines an aperture 72, in this embodiment being a hexagonal socket. The threaded fastener's first end 60 is threaded to be mateable with the internal threads 31 of the boss 30 of the bow. The threaded fastener's second end 70 is threaded to be mateable with the threads of the threaded pocket 90. The first threaded portion being an internally threaded receptacle 31 of boss 30 in this embodiment fits within the rear pocket 92 of the shoe. The threaded fastener 50 is rotatable with respect to the bow with the threaded receptacle 31 prior to completion of assembly. The receptacle is configured to mate with the fastener. The fastener includes a right-handed threaded portion and a left-handed threaded portion, wherein a first one of the right-handed threaded portion and the left handed threaded portion is configured to threadably engage the bow at the receptacle 31, and the other one of the right handed threaded portion and the left handed threaded portion is configured to threadably engage the connection facility 90 of the shoe.

FIG. 7C shows that the pistol 300 frame 302 defines a magazine well 304 and a trigger bow passage 320 associated with the magazine well and extending in a fore and aft direction, and a trigger shoe passage 322 forward of the trigger bow passage. The trigger bow 20 is constrained within the trigger bow channel. The trigger shoe passage 322 constrains lateral and rotational movement of the trigger shoe 80, and wherein the shoe is at least partially contained within the trigger shoe passage.

Figure 8A:
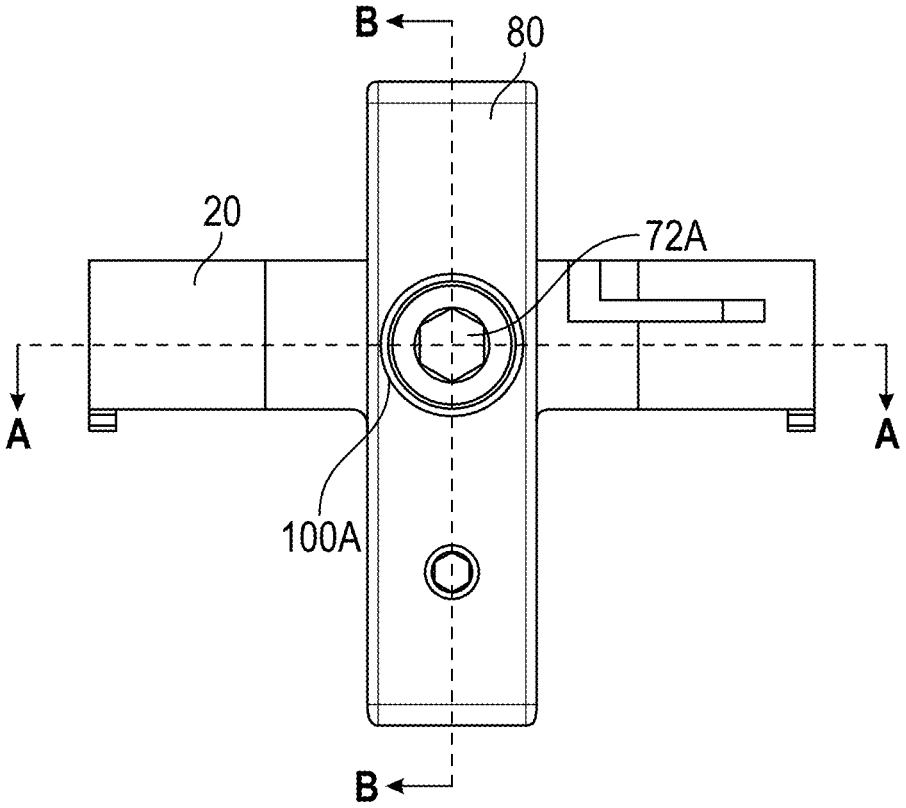
FIG. 8A shows a front view of the trigger assembly.
Figure 8B:
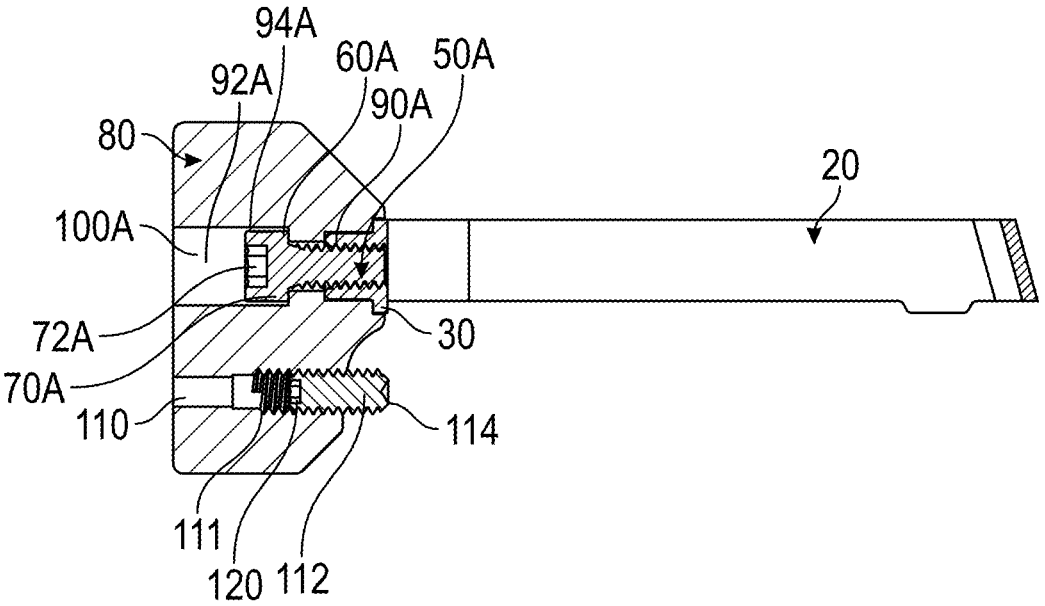
FIG. 8B shows a side section view of the trigger assembly of FIG. 9A.
Figure 8C:
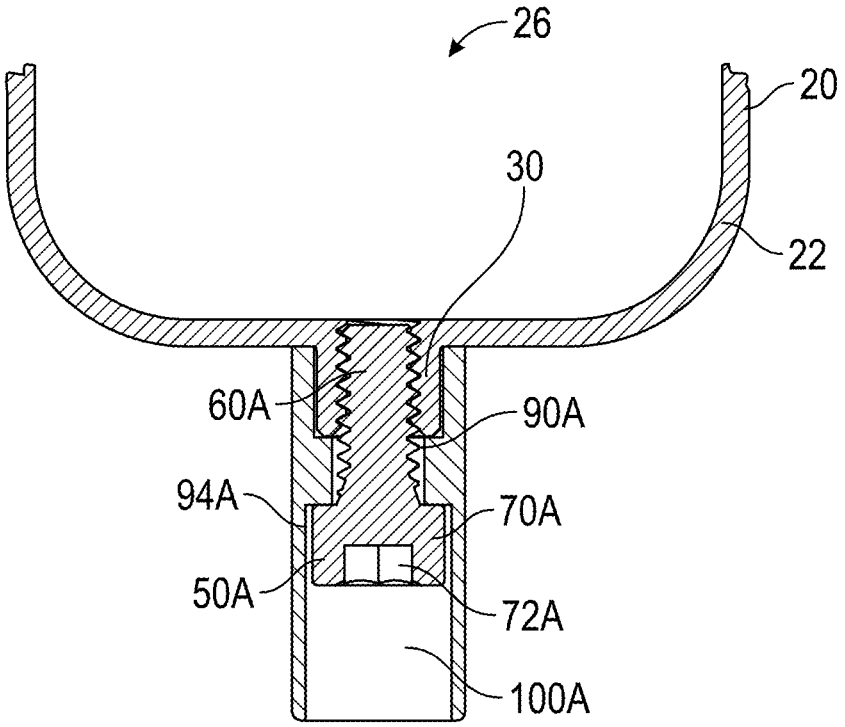
FIG. 8C shows a top-down section view of the trigger assembly of FIG. 9A.

FIG. 8A through 8C show another embodiment of the trigger assembly 10. FIG. 8A shows a front view, FIG. 8B shows a side section view, and FIG. 9C shows a top-down section view. The fastener 50A is free of threaded engagement with the shoe 80. In this embodiment the fastener is a socket head screw 50A having a threaded portion 60A configured to mate with the threaded receptacle 31 of the bow 20. The shoe defines a clearance hole 90A receiving the threaded portion and having a forward pocket 92A defining a shoulder 94A and configured to receive a head 70A of the screw inserted through aperture 100A. The head defining an aperture 72A that accommodates a tool 200 (not shown here but generally the same as described in other embodiments above).

Figure 9:
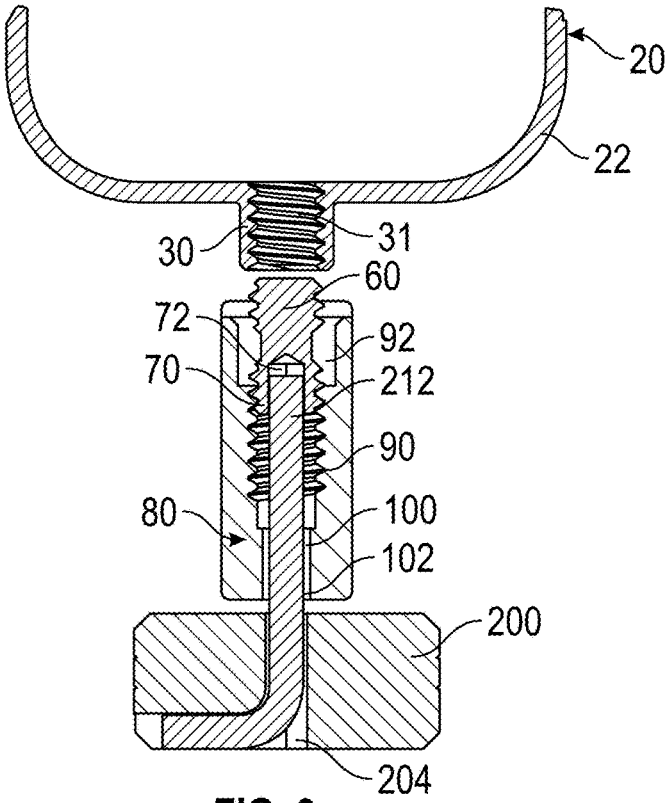
FIG. 9 shows a top-down section view of the trigger assembly prior to being fully assembled.
Figure 10:
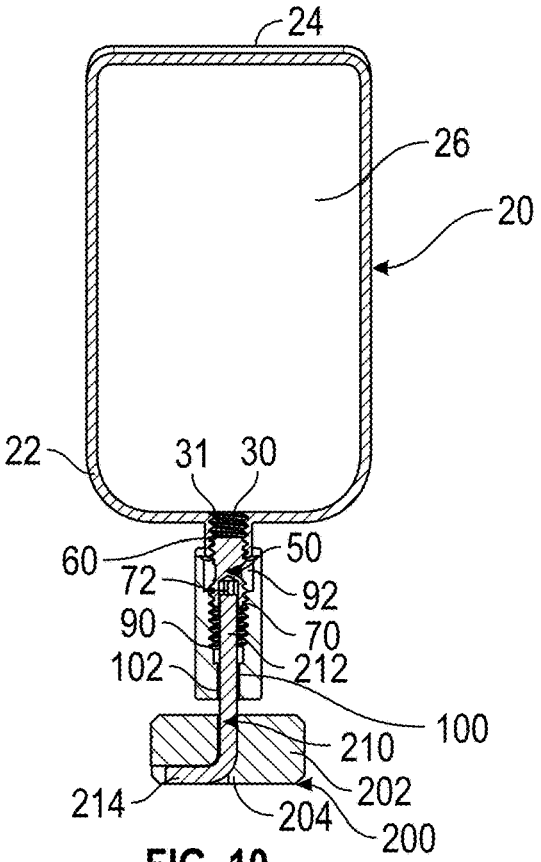
FIG. 10 shows a top-down section view of the trigger assembly prior to being fully assembled.
Figure 11:
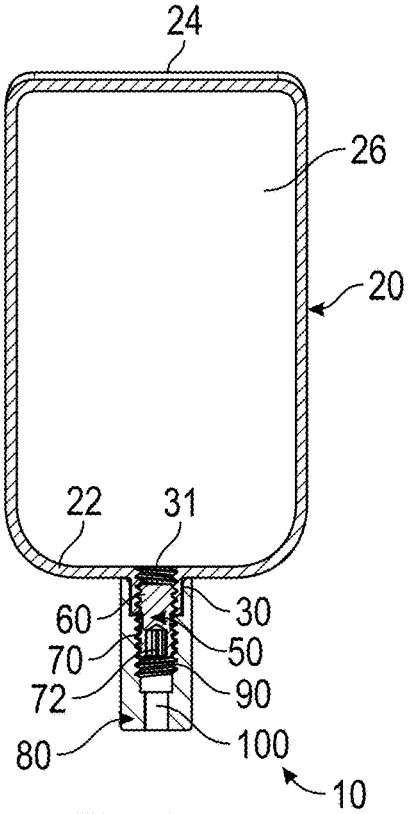
FIG. 11 shows a top-down section view of the trigger assembly fully assembled.

FIGS. 9 through 11 show a top-down section view of the trigger assembly in the installation process. FIG. 9 shows the trigger shoe 80 and threaded fastener 50 are connected and the shoe is to be connected to the trigger bow 20 but the boss 30 is not inserted into rear pocket 92. The trigger bow has a first end 82 and second end 84 with a passage 100 communicating between the two ends. The passage having a tool access aperture 102 defined by the first end, a rear socket 92 defined by the second end, and connection facility 90 in between. The connection facility is referred to as a threaded pocket and is threaded. The threaded fastener having a first end 60, a middle section 52, and a second end 70. The first end and second end are threaded in opposing directions and the middle section is unthreaded. The second end defines an aperture 72, in this embodiment being a hexagonal socket. The threaded fastener's first end 60 is threaded to be mateable with the internal threads of the threaded portion 31 of the bow. The threaded fastener's second end 70 is threaded to be mateable with the threads of the threaded pocket 90. The first threaded portion being an internally threaded receptacle 31 of a boss 30 in this embodiment fits within the rear pocket 92 of the shoe. The hexagonal end 212 of the wrench 210 is inserted into the tool access aperture 102 and through the passage 100 and partially protrudes from the threaded pocket and into the rear pocket 92. The threaded fastener 50 is inserted into the rear pocket and attached to the wrench by inserting the hexagonal end 212 into the hexagonal aperture 72. FIG. 10 shows top-down section view of the trigger assembly 10 with trigger shoe 80 being connected to the trigger bow 20 where the threaded fastener 50 has its first end 60 partially threaded into the threaded receptacle 31, but the boss 30 is not yet within the rear pocket 92 of the shoe. FIG. 11 shows a top-down section view of the trigger assembly of FIG. 9 fully assembled.

Figure 12A:
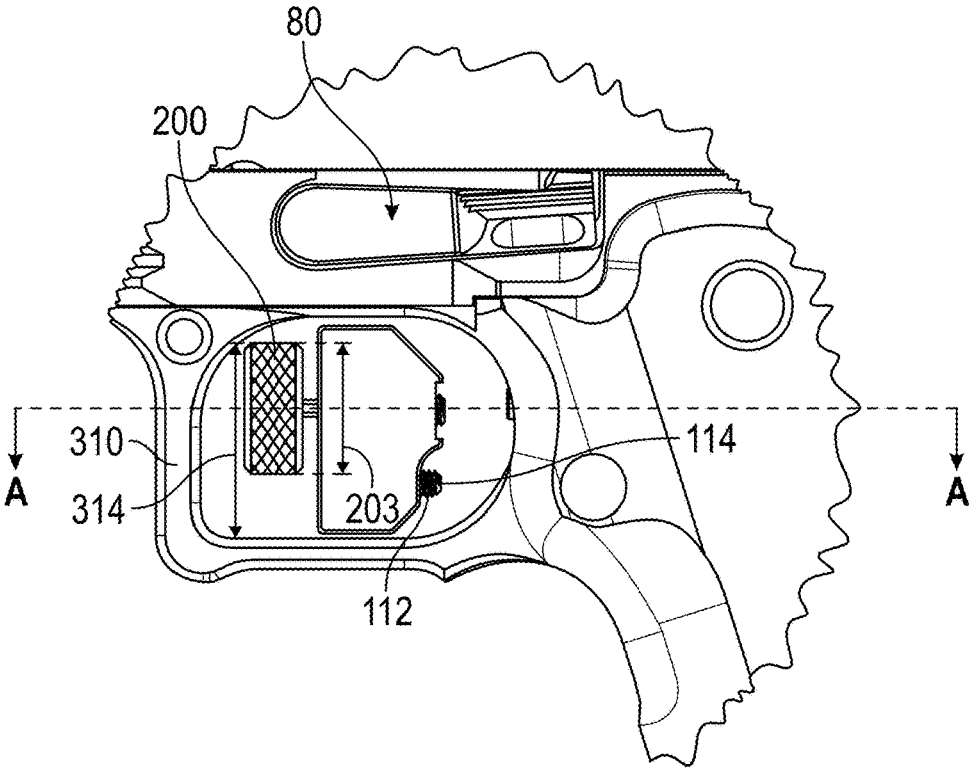
FIG. 12A shows side view of the trigger shoe removed from the trigger bow.
Figure 12B:
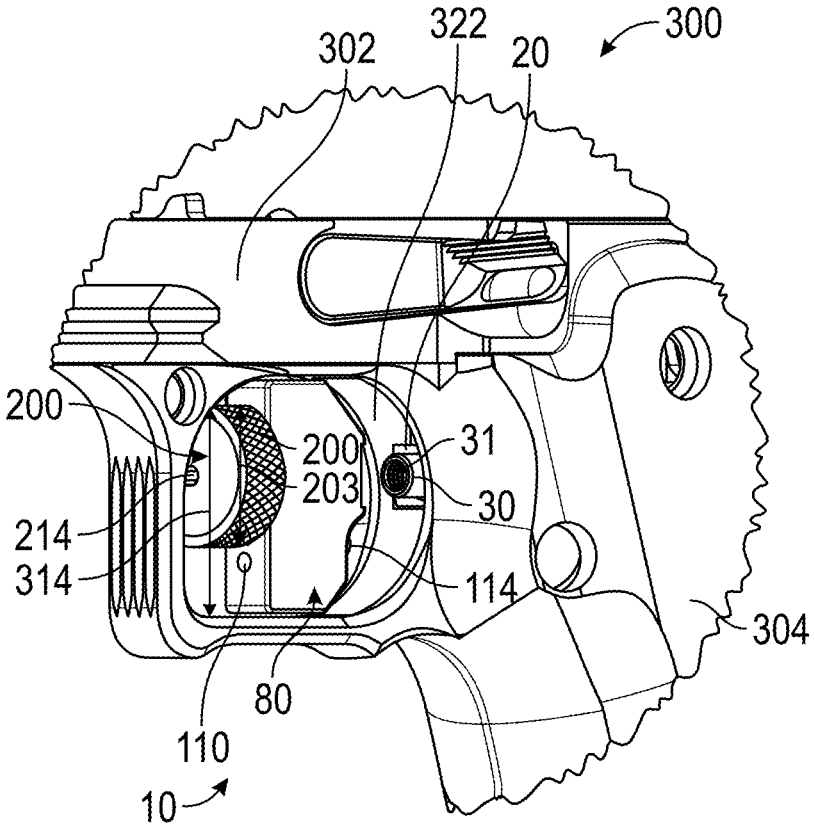
FIG. 12B shows an angled view the trigger shoe removed from the trigger bow of FIG. 12A.
Figure 12C:
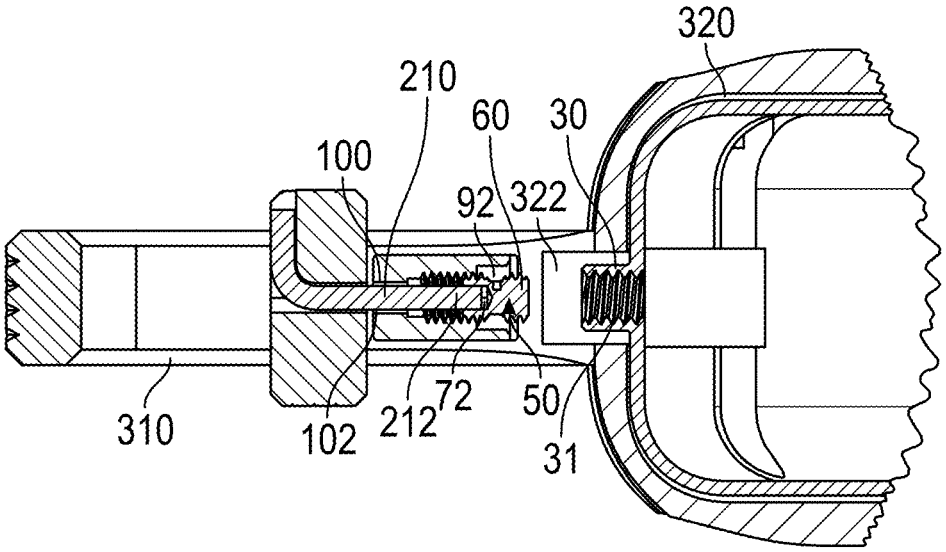
FIG. 12C shows a top-down section view of FIG. 12A.
Figure 12D:
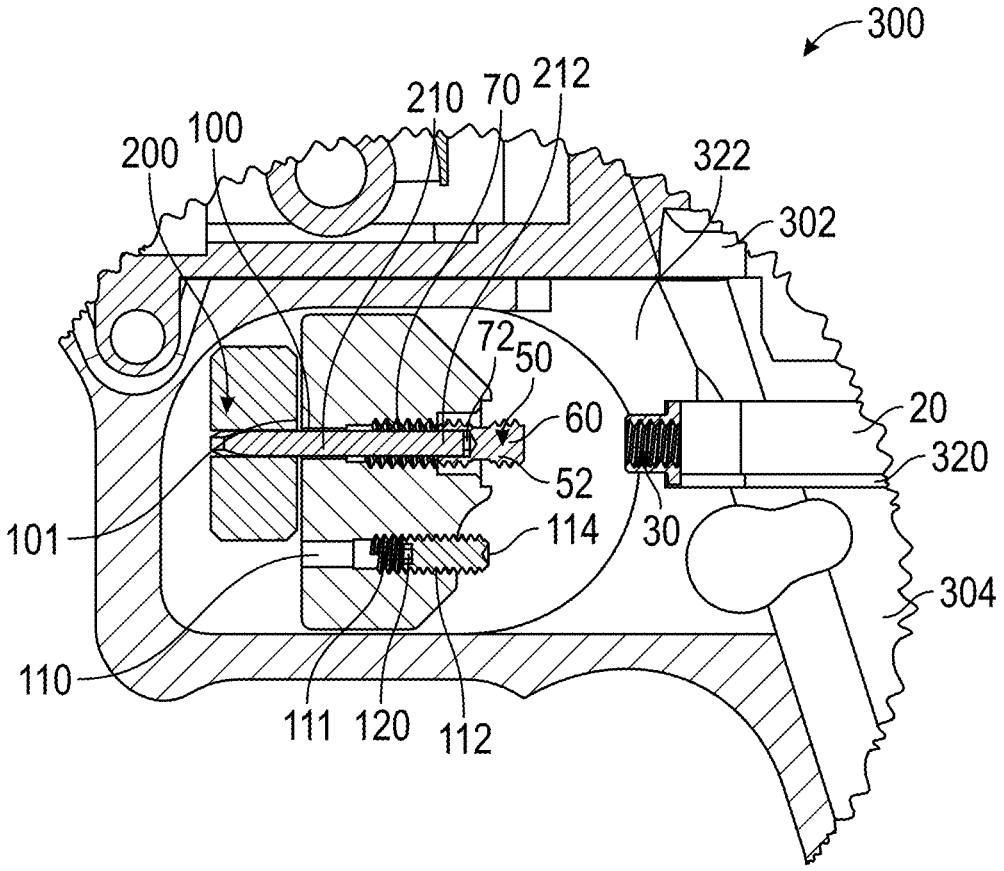
FIG. 12D shows a side-section view of FIG. 12A.

FIG. 12A through 12D shows the trigger shoe 80 completely separated from the trigger bow 20 with the installation tool 200 still inserted. FIG. 12A shows a side view, FIG. 12B shows an angled view, FIG. 12C shows a top-down section view through section line A-A of FIG. 12A, and FIG. 12D shows a side section view of FIG. 12A. The trigger assembly comprises of a bow 20, a shoe 80, and threaded fastener 50. The threaded fastener connects the shoe to the bow and the shoe is partially within trigger shoe passage 322 of frame 302. Passage 322 restricts the lateral and rotational movement of the shoe. The bow has a threaded portion that is a protruding boss 30 having an internally threaded receptacle 31. The trigger bow has a first end 82 and second end 84 with a passage 100 communicating between the two ends. The passage has a tool access aperture 102 defined by the first end, a rear socket 92 defined by the second end, and connection facility 90 in between. The connection facility is referred to as a threaded pocket and is threaded. The threaded fastener has a first end 60, a middle section 52, and a second end 70. The first end and second end are threaded in opposing directions and the middle section is unthreaded. The second end defines an aperture 72, in this embodiment being a hexagonal socket. The threaded fastener's first end 60 is threaded to be mateable with the internal threads of the threaded receptacle 31 of the bow. The threaded fastener's second end 70 is threaded to be mateable with the threads of the threaded pocket 90. The first threaded portion being an internally threaded receptacle 31 in a boss 30 that mates with the rear pocket 92 of the shoe. The threaded fastener 50 is rotatable with respect to the bow with the threaded receptacle 31 prior to completion of assembly. The receptacle is configured to mate with the fastener. The fastener includes a right-handed threaded portion and a left-handed threaded portion, wherein a first one of the right-handed threaded portion and the left handed threaded portion is configured to threadably engage the bow at the receptacle 31, and the other one of the right handed threaded portion and the left handed threaded portion is configured to threadably engage the connection facility 90 of the shoe.

FIG. 12A further shows the diameter 203 of the installation tool 200 is smaller than height 314 of the trigger guard 310 at the point where the bow is removed from the bow, thus allowing the tool to rotate without being obstructed by the trigger guard.

FIG. 12B shows the second end 114 of the overtravel stop screw 112 protruding from the shoe 80. The view further shows that the body 202 of the installation tool 200 has a smaller diameter 203 than the height 314 of the trigger guard when the tool and shoe are removed from the bow.

FIG. 12C more clearly shows that the pistol 300 frame 302 defines a magazine well 304 and a trigger bow passage 320 associated with the magazine well and extending in a fore and aft direction, and a trigger shoe passage 322 forward of the trigger bow passage. The trigger shoe 80 is not constrained within the trigger shoe passage due to the shoe being completely removed from the passage.

I claim:

1. A trigger assembly for a 1911 format pistol comprising:

a trigger bow having a forward portion defining a first threaded portion;

a threaded fastener having a second threaded portion mateable with the first threaded portion;

a trigger shoe configured to operably engage the threaded fastener to secure the trigger shoe to the trigger bow; and wherein the first threaded portion of the bow is an internally threaded receptacle configured to mate with the fastener.

2. The trigger assembly of claim 1 wherein the fastener is rotatable with respect to the shoe.

3. The trigger assembly of claim 1 wherein the fastener is free of threaded engagement with the shoe.

4. The trigger assembly of claim 1 wherein the threaded fastener is rotatable with respect to the bow.

5. The trigger assembly of claim 1 wherein the fastener is a socket head screw having a threaded portion configured to mate with the threaded receptacle, and the shoe defines a clearance hole receiving the threaded portion and having a forward pocket defining a shoulder and configured to receive a head of the screw.

6. The trigger assembly of claim 1 wherein the fastener is externally threaded and defines a hexagonal pocket configured to engage a wrench.

7. The trigger assembly of claim 1 wherein the shoe defines a threaded pocket open to the rear.

8. The trigger assembly of claim 1 wherein the pistol defines a trigger shoe passage constraining lateral and rotational movement of the trigger shoe, and wherein the shoe is at least partially contained within the trigger shoe passage.

9. A trigger assembly for a 1911 format pistol comprising:

a trigger bow having a forward portion defining a first threaded portion;

a threaded fastener having a second threaded portion mateable with the first threaded portion;

a trigger shoe configured to operably engage the threaded fastener to secure the trigger shoe to the trigger bow;

wherein the fastener includes a right-handed threaded portion and a left-handed threaded portion; and wherein a first one of the right-handed threaded portion and the left handed threaded portion is configured to threadably engage the bow and the other one of the right handed threaded portion and the left handed threaded portion is configured to threadably engage the shoe.

10. A trigger assembly for a 1911 format pistol comprising:

a trigger bow having a forward portion defining a first threaded portion;

a threaded fastener having a second threaded portion mateable with the first threaded portion;

a trigger shoe configured to operably engage the threaded fastener to secure the trigger shoe to the trigger bow;

wherein the shoe defines a tool access aperture registered with the threaded pocket and open in a forward direction; and wherein the tool access aperture has a smaller diameter than the threaded pocket.

11. A trigger assembly for a pistol having a frame defining a magazine well and a trigger bow passage associated with the magazine well and extending in a fore and aft direction, and a trigger shoe passage forward of the trigger bow passage, the trigger assembly comprising:

a trigger bow configured to be received in the trigger bow passage and defining an aperture configured to encircle the magazine well to enable passage of a magazine;

a trigger shoe removably connected to the trigger bow and configured to be slidably received in the trigger shoe passage;

the trigger shoe configured to be restrained against rotation in the trigger shoe passage and enabled only for removal in a forward direction from the trigger shoe passage;

a fastener operably connected to the trigger shoe and to the trigger bow and operable to secure the trigger shoe to the trigger bow when attached, and when detached to enable extraction of the trigger shoe from the trigger shoe passage in a forward direction while the trigger bow is retained in the frame; and wherein the bow has an internally threaded receptacle configured to mate with the fastener.

12. The trigger assembly of claim 11 wherein the fastener is rotatable with respect to the shoe.

13. The trigger assembly of claim 11 wherein the fastener is free of threaded engagement with the shoe.

14. The trigger assembly of claim 11 wherein the threaded fastener is rotatable with respect to the bow.

15. The trigger assembly of claim 11 wherein the fastener is a socket head screw having a threaded portion configured to mate with the threaded receptacle, and the shoe defines a clearance hole receiving the threaded portion and having a forward pocket defining a shoulder and configured to receive a head of the screw.

16. The trigger assembly of claim 11 wherein the fastener is externally threaded and defines a hexagonal pocket configured to engage a wrench.

17. A trigger assembly for a pistol having a frame defining a magazine well and a trigger bow passage associated with the magazine well and extending in a fore and aft direction, and a trigger shoe passage forward of the trigger bow passage, the trigger assembly comprising:

a trigger bow configured to be received in the trigger bow passage and defining an aperture configured to encircle the magazine well to enable passage of a magazine;

a trigger shoe removably connected to the trigger bow and configured to be slidably received in the trigger shoe passage;

the trigger shoe configured to be restrained against rotation in the trigger shoe passage and enabled only for removal in a forward direction from the trigger shoe passage;

a fastener operably connected to the trigger shoe and to the trigger bow and operable to secure the trigger shoe to the trigger bow when attached, and when detached to enable extraction of the trigger shoe from the trigger shoe passage in a forward direction while the trigger bow is retained in the frame; and wherein the fastener includes a right handed threaded portion and a left handed threaded portion.

18. The trigger assembly of claim 17 wherein a first one of the right handed threaded portion and the left handed threaded portion is configured to threadably engage the bow and the other one of the right handed threaded portion and the left handed threaded portion is configured to threadably engage the shoe.

19. A trigger assembly for a pistol having a frame defining a magazine well and a trigger bow passage associated with the magazine well and extending in a fore and aft direction, and a trigger shoe passage forward of the trigger bow passage, the trigger assembly comprising:

a trigger bow configured to be received in the trigger bow passage and defining an aperture configured to encircle the magazine well to enable passage of a magazine;

a trigger shoe removably connected to the trigger bow and configured to be slidably received in the trigger shoe passage;

the trigger shoe configured to be restrained against rotation in the trigger shoe passage and enabled only for removal in a forward direction from the trigger shoe passage;

a fastener operably connected to the trigger shoe and to the trigger bow and operable to secure the trigger shoe to the trigger bow when attached, and when detached to enable extraction of the trigger shoe from the trigger shoe passage in a forward direction while the trigger bow is retained in the frame; and wherein the shoe defines a threaded pocket open to the rear.

20. The trigger assembly of claim 19 wherein the shoe defines a tool access aperture registered with the threaded pocket and open in a forward direction.

21. The trigger assembly of claim 20 wherein the tool access aperture has a smaller diameter than the threaded pocket.

22. A trigger assembly for a firearm comprising:

a bow element having a first end defining a connecting portion and a second end opposite to the first end;

a shoe element with at least one connection facility;

an intermediate element with a first end and second end, wherein the first end connects e to the shoe element and the second end connects to the connecting portion; and wherein at least one connection facility is at least partially threaded in a direction opposite a threading direction of the connecting portion.

23. The trigger assembly of claim 22 wherein the connecting portion of the bow element has an internally threaded aperture.

24. The trigger assembly of claim 22 wherein the shoe element has a first side and a second side with at least one passage communicating from the first side to the second side.

25. The trigger assembly of claim 22 wherein the intermediate element has a first end threaded to be mateable to at least one connection facility of the shoe element and a second end mateable to the connecting portion of the bow element.

26. The trigger assembly of claim 22 wherein the shoe element has a passage that can accommodate a moveable stopping member inserted into the passage.

27. A trigger assembly for a firearm comprising:

a bow element having a first end defining a connecting portion and a second end opposite to the first end;

a shoe element with at least one connection facility; and an intermediate element with a first end and second end, wherein the first end connects e to the shoe element and the second end connects to the connecting portion;

wherein the intermediate element's first end defines an aperture; and wherein a tool is inserted through at least one connection facility of the shoe element and into the aperture of the intermediate element to provide means for turning of the intermediate element.

* * * * *